US006547413B2

(12) United States Patent
Hung

(10) Patent No.: US 6,547,413 B2
(45) Date of Patent: Apr. 15, 2003

(54) BUILT-IN LAMP APPARATUS FOR SUSPENDED CEILINGS

(76) Inventor: Ming-Hua Hung, 1F, No. 189, YungFeng Road, TuCheng City, Taipei Hsien (TW)

( * ) Notice: Subject to any disclaimer, the term of this patent is extended or adjusted under 35 U.S.C. 154(b) by 0 days.

(21) Appl. No.: 09/815,834

(22) Filed: Mar. 24, 2001

(65) Prior Publication Data

US 2002/0136000 A1 Sep. 26, 2002

(51) Int. Cl.[7] ..... F21S 8/04

(52) U.S. Cl. ..... 362/148; 362/311; 362/225; 362/405

(58) Field of Search ..... 362/147, 148, 362/150, 249, 364, 365, 363, 225, 404, 405, 406, 408; D26/24

(56) References Cited

U.S. PATENT DOCUMENTS 1,022,878 A * 4/1912 Ryan ..... 362/235
1,174,655 A * 3/1916 Bauer ..... 362/408
1,844,639 A * 2/1932 Crumpton ..... 220/662
3,024,356 A * 3/1962 Florence ..... 362/363
3,590,238 A * 6/1971 Arens ..... 362/285
4,602,321 A * 7/1986 Bornhorst ..... 362/268
5,174,648 A * 12/1992 Clary et al. ..... 362/228
5,197,798 A * 3/1993 Tickner ..... 362/216
5,249,107 A * 9/1993 Poulsen ..... 362/147
6,109,766 A * 8/2000 Baliozian ..... 362/233

* cited by examiner

*Primary Examiner*—Thomas M. Sember
*Assistant Examiner*—Hargobind S. Sawhney
(74) *Attorney, Agent, or Firm*—Walter J. Tencza, Jr.

(57) ABSTRACT

Built-in lamp apparatus for suspended ceilings is provided with a base fixed in the space provided in the suspended ceiling, wherein a reflection cover is installed on the base. A fixed seat and a bulb socket holder are installed inside and in the top of the reflection cover respectively. The bulb socket holder comprises a plurality of fixed plates provided on the periphery of a baseboard. One to four bulb sockets and bulbs can be installed on the plurality of fixed plates. On the center of the baseboard is placed a vertical center shaft, which extends upwardly. The center shaft extends further to the top of the reflection cover, wherein a heat-dissipating passage is provided on the top of the reflection cover. Pass the hollow sphere-shaped lampshade through the base hole of the above-described base and then connects the lampshade top with the described fixed seat. Consequently, the bulb socket holder, bulb sockets, and bulbs are contained inside the space of the lampshade. The lampshade may have a variety of colors, coupled with its sphere shape, creating a fresh atmosphere and emitting harmonized and soft light.

13 Claims, 5 Drawing Sheets

BUILT-IN LAMP APPARATUS FOR SUSPENDED CEILINGS

FIELD OF THE INVENTION

The aim of the innovation, is to provide built-in lamp apparatus for suspended ceilings; and in particular, to improve the shortcomings of the traditional open-style lamp apparatus mounted on a suspended ceiling in addition to obtaining better visual perception aesthetically. The improvement can transform the glaring light into softening light, which is less likely to fatigue our eyes, and, when operated in connection with an electronic switch, can provide a multi-stage adjustment of lumen, which in turn can provide diverse indoor luminosity and suit practical demands.

DESCRIPTION OF THE PRIOR ART

Ordinary lamp apparatus for a suspended ceiling is a planar fluorescent lamp set, of which structural feature is no ceiling is given on the space reserved for the fluorescent lamp set. The fluorescent lamp set comprises a planar refection cover, a plurality of fluorescent tubes, and a grid frame. The fluorescent tubes are mounted between the grid frame and the reflection cover. The light comes from the light emitted directly from the fluorescent tubes as well as from the light reflecting upon the reflection cover. Although the aforementioned suspended ceiling fluorescent lamp set has been used for many years with practical merits, there are indeed many shortcomings, which can be described as follows.

1. The grid frame is made up of a plurality of cross-linked metal strips. It is an open-style barrier from which the light comes down without passing a light filter, so the light is usually too strong and glaring for human eyes to look. People inside the room would feel uncomfortable looking at the fluorescent tubes when raising their heads. Although the traditional suspended ceiling lamp apparatus can be equipped with a lampshade, it is a planar piece and is mounted in the suspended ceiling. Since the lampshade is also parallel with the ceiling, the overall visual effect is dull and without novelty.
2. When the switch is turned on, the plurality of fluorescent tubes will glow altogether, and they will darken simultaneously when the switch is turned off. Indoor luminosity can not be adjusted to obtain desired lumen.
3. If the number of tube sockets are not installed according to design, people could feel the lighting unbalanced inside the area of the reflection cover.

Accordingly, the present innovation is to improve the shortcomings of the above-described fluorescent lamp set for suspended ceilings, making it more practical in use and more aesthetic visually.

SUMMARY OF THE INVENTION

The first aim of the present innovation is to provide built-in lamp apparatus for suspended ceilings, with the light not coming directly from the tubes, but passing through the lampshade, making the indoor luminosity soft and innocuous to eyes.

The second aim of the present innovation is to provide built-in lamp apparatus for suspended ceilings, with a sphere-shaped lampshade inserted in the ceiling to diversify the ceiling and improve the aesthetic perception.

The third aim of the present innovation is to provide built-in lamp apparatus for suspended ceilings, with an exquisite design of bulb sockets, where consumers can install one to four bulbs accordingly and arrange the bulbs in a balanced style, making the light uniform and soft.

The fourth aim of the present innovation is to provide built-in lamp apparatus for suspended ceilings, with an electronic controlling switch to control the number of bulbs glowing in order to control the desired lumen of the room.

Consequently, the present innovation is to provide built-in lamp apparatus for suspended ceilings. A base is fixed in the space provided in the suspended ceiling, wherein a reflection cover is installed on the base. A fixed seat and a bulb socket holder are installed inside and in the top of the reflection cover respectively. The bulb socket holder comprises a plurality of fixed plates provided on the periphery of a baseboard. One to four bulb sockets and bulbs can be installed on the plurality of fixed plates. On the center of the baseboard a vertical center shaft, which extends upwardly, is placed. The center shaft extends further to the top of the reflection cover, wherein a heat-dissipating passage is provided on the top of the reflection cover. Pass the hollow sphere-shaped lampshade through the base hole of the above-described base and then connects the lampshade top with the described fixed seat. Consequently, the bulb socket holder, bulb sockets, and bulbs are contained inside the space of the lampshade. The lampshade may have a variety of colors, coupled with its sphere shape, creating a fresh atmosphere and emitting harmonized and soft light.

The present innovation and its aims and functions can be better understood with reference to the following figures.

DETAILED DESCRIPTION OF THE INVENTION

Figure 1:
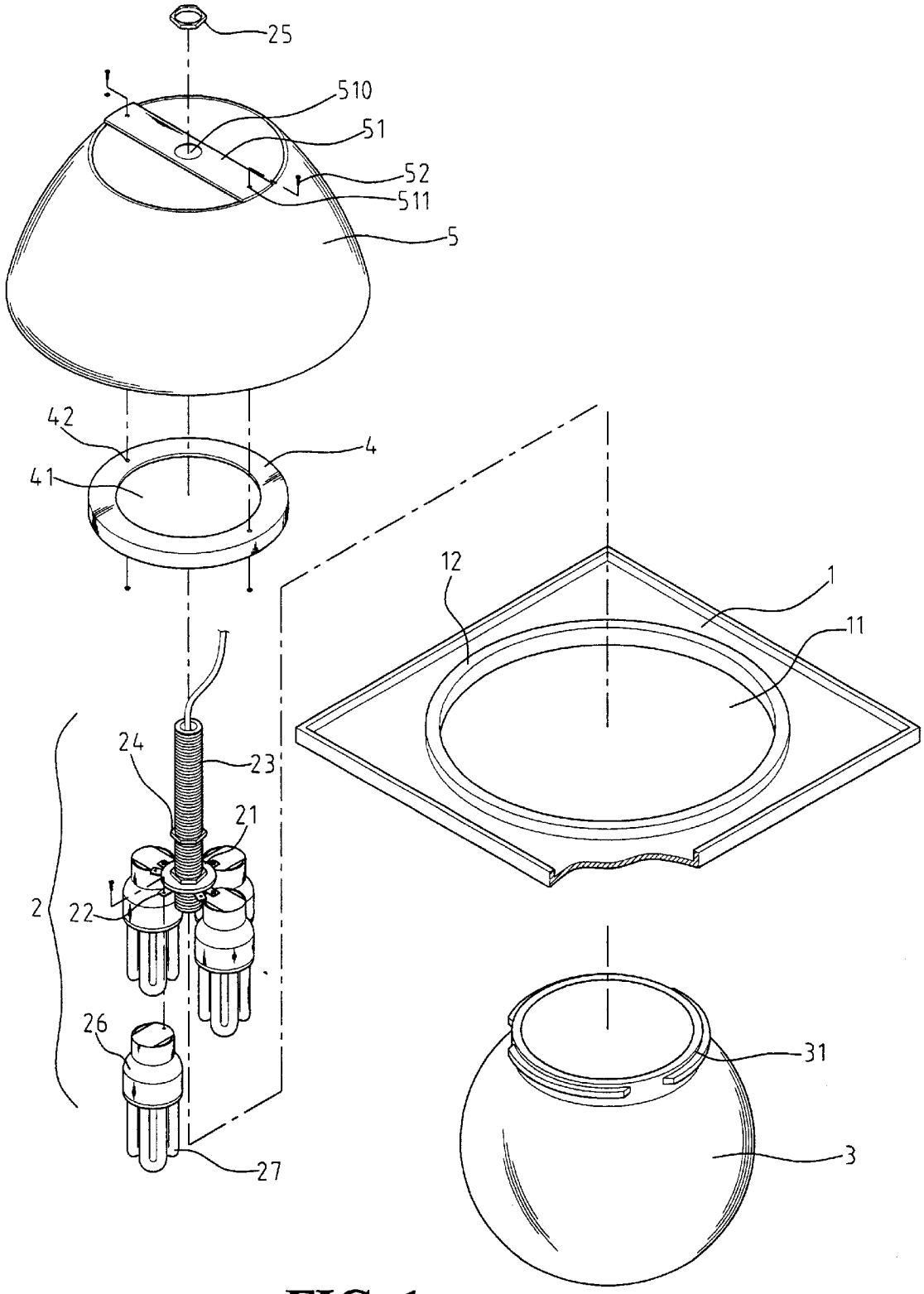
FIG. 1 is an exploded perspective view of the present innovation.

Referring to FIG. 1, the present innovation is to provide built-in lamp apparatus for suspended ceilings, where the lamp apparatus comprises a base 1, a bulb socket holder 2, a bulb socket 26 for setting a plurality of assorted bulbs 27, a lampshade 3, a fixed seat 4, and a reflection cover 5.

Among them, the base 1 is to be inserted in the suspended ceiling, wherein the base comprises a base hole 11, and a flange 12 provided on the periphery over the base hole 11.

A preferred embodiment of the reflection cover 5 is a conical cover with a smooth and curved inner surface capable of reflecting light, generated by the glowing bulbs. On the top of interpenetrated it is interpenetrated on its top for dissipating heat part of reflection cover is provided with a girder 51, which is in turn provided with a center hole 510. On both side of the center hole 510, several screw holes 511 are provided on appropriate area of the girder 51.

Figure 3B:
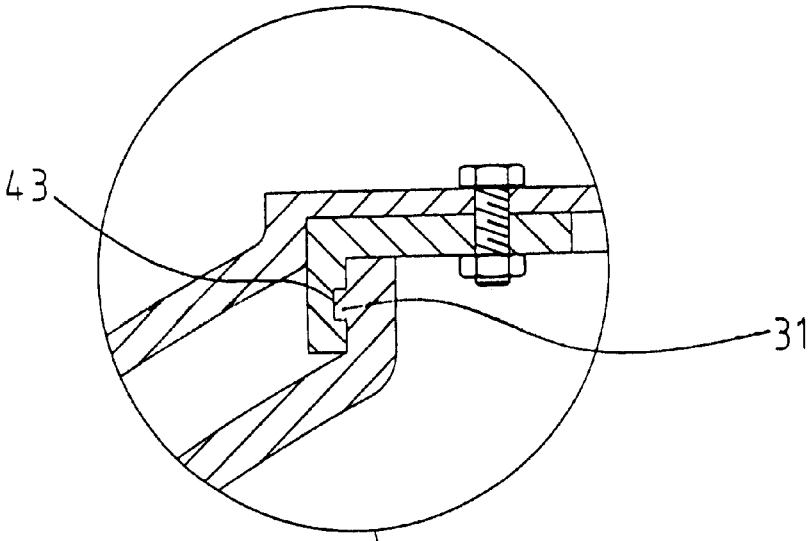
FIG. 3 is a cross-sectional plan of the overall structure of the present innovation after assembly.
Figure 3A:
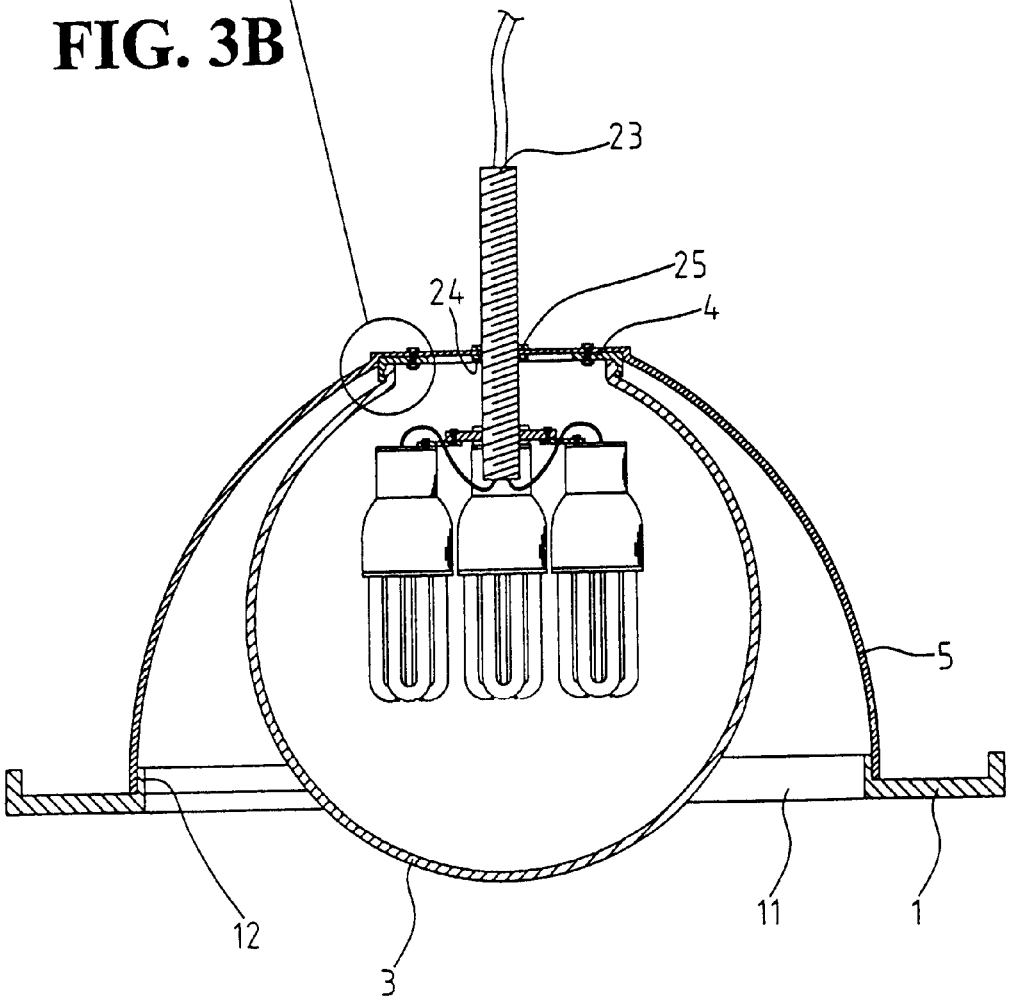

The fixed seat 4 is a disk-like object with a seat hole 41 on its center and a plurality of screw holes 42 on its top, wherein the plurality of screw holes 42 correspond to the described screw holes 511. Also, on the inner side of the fixed seat 4 are provided with concave, like mortise 43 or inner thread (as shown in FIG. 3).

The structure of the bulb socket holder 2 comprises of a plurality of fixed plates 22 provided on the periphery of the baseboard 21; wherein at least one of the plurality of bulbs can be installed onto the fixed plates 22. A vertically extending center shaft 23 is provided on the center of the baseboard 21. A preferred embodiment of the center shaft 23 is a hollow spiral pipe. This provides a passage for electric wires and for dissipating heat generated by the glowing bulbs.

Figure 5:
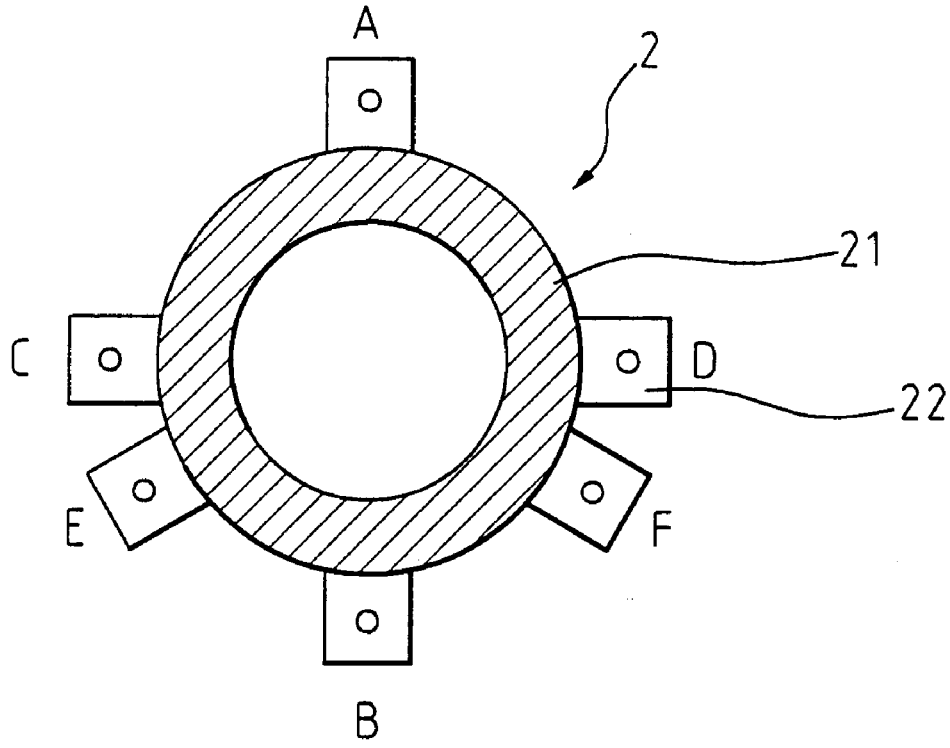
FIG. 5 is a layout plan of the fixed plates provided by the bulb socket holder of the present innovation.

Referring to FIG. 5, a preferred embodiment of the structure of the bulb socket holder 2 is provided with six fixed plates 22 on the periphery of the baseboard 21, designated as A, B, C, D, E, and F. The arrangement of the fixed plates 22 on the baseboard 21 periphery makes A, B, C, and D 90° away from one another, while A, E and F 120° away from one another. The aim of the arrangement is to achieve balanced distribution of light when one to four bulbs are being turned on, and to obtain uniform and soft illumination. For example; if only one bulb is installed, it can be installed at any one of the six fixed plates, A, B, C, D, E, and F. In the case of two bulbs, they can be installed at A and B fixed plates, or C and D fixed plates. This is so as to locate the bulbs at symmetrical positions, and in turn uniformly distribute the light they emit. In case of three bulbs, they can be installed at A, E, and F fixed plates to obtain uniformly distributed illumination. In case of four bulbs, they can be installed at A, B, C, and D fixed plates to obtain uniformly distributed illumination. The described fixed plates 22 have to be jointed on the periphery of the baseboard 21; they can be manufactured as one piece, or they can be screwed, riveted and so on.

A preferred embodiment of the lampshade 3 of the present innovation is a sphere-shaped body with a hollow inner space and an opening on its top. On the periphery of the opening is provided with such convex as tenons 31 or outer thread.

Figure 2:
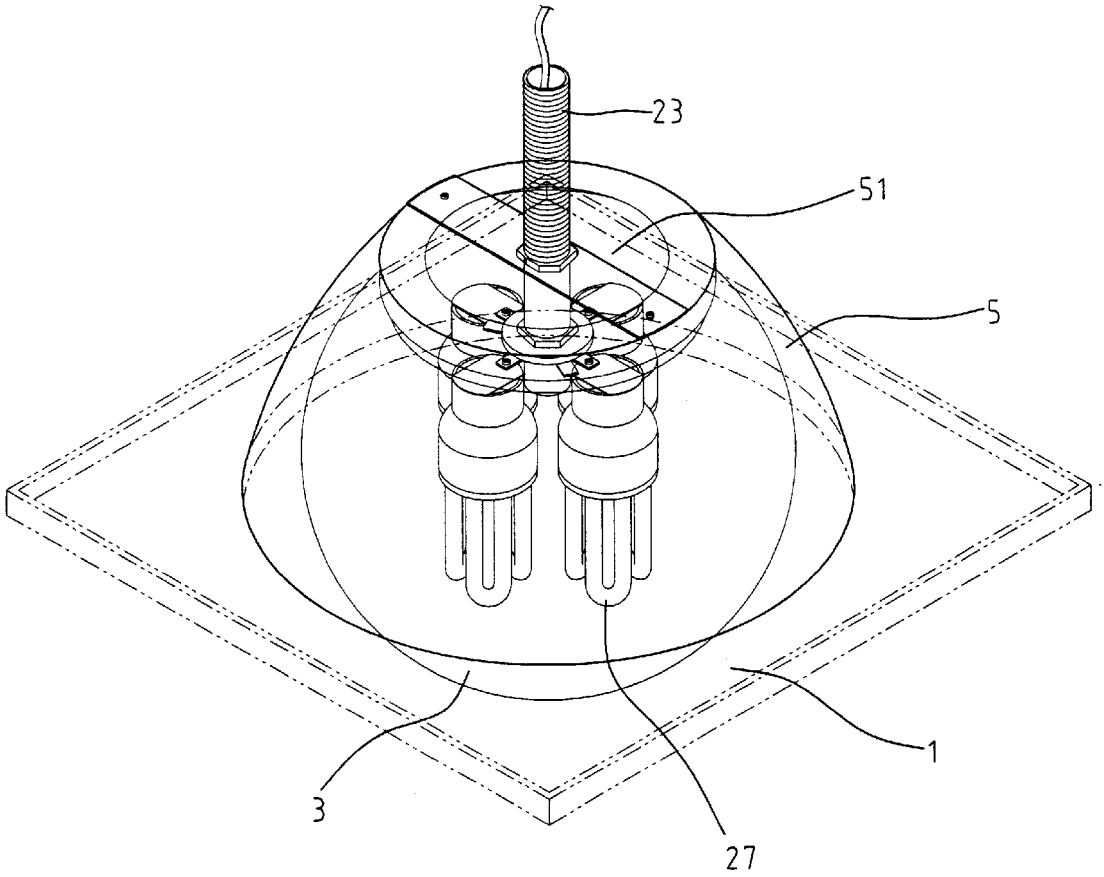
FIG. 2 is a stereograph of the components, shown in FIG. 1, after assembly.
Figure 4:
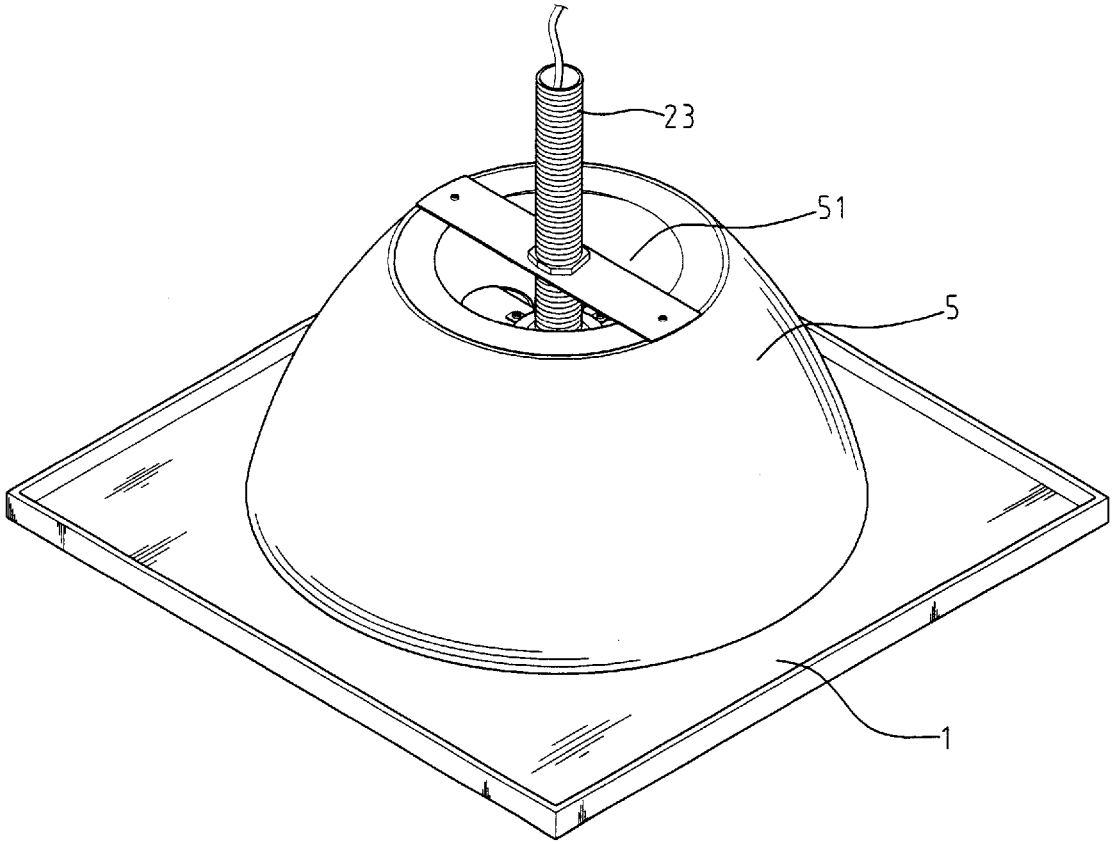
FIG. 4 is a stereograph of the apparent structure of the present innovation after assembly.

Referring to FIGS. 1 to 3, the assembly of the described components of the present innovation is to pass the screws 52 through the screw holes 511 and 42 of the girder 51 and the fixed seat 4, respectively, and then secure the fixed seat 4 against the underside of the girder 51 of the reflection cover 5 by screwing the screws 52 with a nut. Although the fixed seat 4 is secured on the underside of the girder 51, the fixed seat 4 will not obstruct the hollow passage on the top of the reflection cover 5, since the diameter of the base hole is sufficiently large. In other words, after the fixed seat 4 is assembled on the underside of the girder 51 of the reflection cover 5, the passage on the top of the reflection cover is still open and accessible, capable of dissipating the heat generated by the glowing bulbs. Also, the bulb sockets 26 fitted with bulbs 27 are screwed onto the fixed plate 22 of the bulb socket holder 2. As for the arrangement of the bulb sockets 26 on the fixed plate 22 can follow the described method according to the number of bulb sockets installed. The hollow spiral pipe used as a center shaft 23 should be screwed with a nut 24 in advance, and then the center shaft 23 is put through the center hole 510 of the girder 51. At least another nut 25 is used to secure the center shaft 23, and both nuts 24 and 25 are tightened on the upside and downside of the girder 51 respectively to secure the center shaft 23 against the girder 51. The electric wire, after being pulled through the hollow center shaft 23 from its top and coming out from bottom, is connected to the contacts of the plurality of the bulb sockets with its sub-wires. Furthermore, users can adjust the distance between the light source and the floor to suit their needs. The adjustment is first to unscrew the nuts 24 and 25, and move the center shaft 23 vertically, which in turn moves the bulbs 27 higher or lower, to a proper position, and finally tighten the nuts 24 and 25. After the fixed seat 4, the bulb socket holder 2, the bulb sockets 26, and bulbs 27 are being assembled, the reflection cover 5 can be positioned by engaging into the periphery of the flange 12 provided on the upper part of the base 1 (as shown in FIG. 3), in a way that the bottom of the reflection cover 5 can be located in a place opposite to the base hole 11 of the base 1. Finally, the tenons 31 of the lampshade 3 is engaged firmly into the mortise 43 of the fixed seat 4, making the bulbs 27 and the bulb sockets 26 are contained within the hollow space of the lampshade 3. The overall appearance of the assembled set is shown in FIG. 4.

Apart from by engaging tenons and mortise as described earlier, the connection of the lampshade 3 and the fixed seat 4 can also be achieved by screwing the inner thread provided with the inner surface of the fixed seat 4 and the outer thread provided with the outer surface of the lampshade 3.

According to the described apparatus of the present innovation, the apparatus has at least the following advantages:

1. A variety of the lampshade colors are provided to meet the diverging demand of customers, and the colors can also change the glaring light into soft light, which can bring comfort to eyes.
2. The bulb socket holder can be hidden inside the lampshade, producing better visual effect, and the sphere-shaped lampshade also has better stereoscopic effect, yielding better aesthetic sense than the traditional planar fluorescent tube set.
3. An electronically controlled switch can be incorporated with the present lamp apparatus to conveniently adjust the desired lumen of the room.
4. One to four bulbs can be installed onto the bulb socket holder by choice, and evenly distributed light can be obtained when more than one bulb is installed, yielding balanced and soft light.

It should be understood that the above only describes an example of one embodiment of the present invention, and that various alternations or modifications may be made thereto without departing the spirit of this invention. Therefore, the protection scope of the present invention should be based on the claims described later.

What is claimed is:

1. A built-in lamp apparatus for suspended ceilings comprising:

a base including a base hole;

a reflection cover provided on said base, wherein the bottom of said reflection cover corresponds to said base hole of said base, and the top of said reflection cover has a passage which is open;

a fixed seat provided inside said reflection cover;

a bulb socket holder including a plurality of fixed plates positioned on the periphery of a baseboard, wherein one to four bulb sockets and bulbs can be installed onto said plurality of fixed plates, wherein on the center of said baseboard, said baseboard is provided with a vertical center shaft which extends upwardly, wherein said center shaft is connected to said reflection cover; and a lampshade provided with a hollow inner space and an opening on its top, said lampshade put through said base hole of said base and then said opening on said lampshade top, and then said lampshade is connected with said fixed seat, wherein said bulb socket holder, said bulb sockets, and said bulbs are contained inside the space of the lampshade;

and wherein said bulb socket holder includes six fixed plates, designated as A, B, C, D, E, and F, wherein the arrangement of said fixed plates A, B, C, and D is ninety degrees away from one another, while A, E, and F is one-hundred and twenty degrees away from one another.

2. The apparatus according to claim 1, wherein said lampshade and fixed seat are secured by engaging tenons and mortises.

3. The apparatus according to claim 1, wherein said lampshade and said fixed seat are secured by screwing an outer thread and an inner thread.

4. A built-in lamp apparatus for suspended ceilings comprising:

a base including a base hole;

a reflection cover provided on said base, wherein the bottom of said reflection cover corresponds to said base hole of said base, and the top of said reflection cover has a passage which is open;

a fixed seat provided inside said reflection cover;

a bulb socket holder including a plurality of fixed plates positioned on the periphery of a baseboard, wherein one to four bulb sockets and bulbs can be installed onto said plurality of fixed plates, wherein on the center of said baseboard, said baseboard is provided with a vertical center shaft which extends upwardly, wherein said center shaft is connected to said reflection cover; and a lampshade provided with a hollow inner space and an opening on its top, said lampshade put through said base hole of said base and then said opening on said lampshade top, and then said lampshade is connected to said fixed seat, wherein said bulb socket holder, said bulb sockets, and said bulbs are contained inside the space of the lampshade;

and wherein said lampshade and said fixed seat is secured by engaging tenons and mortises.

5. The apparatus according to claim 4, wherein said lampshade is sphere-shaped.

6. A built-in lamp apparatus for suspended ceilings comprising:

a base including a base hole;

a reflection cover provided on said base, wherein the bottom of said reflection cover corresponds to said base hole of said base, and the top of said reflection cover has a passage which is open;

a fixed seat provided inside said reflection cover;

a bulb socket holder including a plurality of fixed plates positioned on the periphery of a baseboard, wherein one to four bulb sockets and bulbs can be installed onto said plurality of fixed plates, wherein on the center of said baseboard, said baseboard is provided with a vertical center shaft which extends upwardly, wherein said center shaft is connected to said reflection cover; and a lampshade provided with a hollow inner space and an opening on its top, said lampshade put through said base hole of said base and then said opening on said lampshade top, and then said lampshade is connected to said fixed seat, wherein said bulb socket holder, said bulb sockets, and said bulbs are contained inside the space of the lampshade;

wherein the center shaft is a hollow spiral pipe;

a girder is provided near the top of said reflection cover, the girder is provided with a center hole through which the hollow spiral pipe passes, and at least one nut must be screwed on the hollow spiral pipe to fix a position of the hollow spiral pipe with respect to the girder;

wherein said lampshade and said fixed seat is secured by engaging tenons and mortises.

7. A lamp apparatus for suspended ceilings comprising:

a base including a base hole;

a reflection cover provided on said base, wherein the bottom of said reflection cover corresponds to said base hole of said base, and the top of said reflection cover has a passage which is open;

a fixed seat provided inside said reflection cover;

a bulb socket holder including a plurality of fixed plates positioned on the periphery of a baseboard, wherein one to four bulb sockets and bulbs can be installed onto said plurality of fixed plates, wherein on the center of said baseboard, said baseboard is provided with a vertical center shaft which extends upwardly, wherein said center shaft is connected to said reflection cover; and a lampshade provided with a hollow inner space and an opening on its top, said lampshade put through said base hole of said base and then through said opening on said lampshade top, said lampshade then connected with said fixed seat, wherein said bulb socket holder, said bulb sockets, and said bulbs are contained inside the space of the lampshade;

wherein the center shaft is a hollow spiral pipe;

a girder is provided near the top of said reflection cover, the girder is provided with a center hole through which the hollow spiral pipe passes, and at least one nut must be screwed on the hollow spiral pipe to fix a position of the hollow spiral pipe with respect to the girder;

wherein said lampshade and said fixed seat are secured by screwing an outer thread and an inner thread.

8. An apparatus comprising a light source;

and a reflection cover;

wherein the light source can be moved from a first position with respect to the reflection cover to a second position with respect to the reflection cover, wherein the first and second positions are substantially different;

wherein the light source can be operated in either the first position or the second position;

further comprising a lampshade connected to the reflection cover, so that when the light source is moved from the first position to the second position, the light source moves with respect to the lampshade.

9. The apparatus of claim 8, wherein the light source is connected to a shaft which can be moved to move the light source from the first position to the second position.

10. An apparatus comprising a light source;

and a reflection cover;

wherein the light source can be moved from a first position with respect to the reflection cover to a second position with respect to the reflection cover, wherein the first and second positions are substantially different;

wherein the light source can be operated in either the first position or the second position;

wherein the light source is connected to a shaft which can be moved to move the light source from the first position to the second position;

wherein the reflection cover includes a girder;

wherein the light source is fixed at the first position by tightening a first nut on the shaft above the girder and a second nut on the shaft below the girder;

wherein the light source is moved by loosening the first nut and the second nut;

and wherein the light source is fixed at the second position by tightening the first nut above the girder and the second nut below the girder.

11. An apparatus comprising a light source;

and a reflection cover;

wherein the light source can be moved from a first position with respect to the reflection cover to a second position with respect to the reflection cover, wherein the first and second positions are substantially different;

wherein the light source can be operated in either the first position or the second position;

wherein the light source is connected to a shaft which can be moved to move the light source from the first position to the second position;

further comprising a fixed seat;

a lampshade;

wherein the fixed seat can be fixed to the reflection cover;

and wherein the lampshade can be connected to the fixed seat.

12. A bulb socket holder comprising a plurality of fixed plates positioned on the periphery of a baseboard, wherein one to four bulb sockets and bulbs can be installed onto said plurality of fixed plates, and wherein said bulb socket holder includes six fixed plates, designated as A, B, C, D, E, and F, wherein the arrangement of said fixed plates A, B, C, and D is ninety degrees away from one another, while A, E, and F is one-hundred and twenty degrees away from one another.

13. An apparatus comprising a reflection cover having a top and a bottom;

a base adaptable for fixing in a space in a suspended ceiling;

a lampshade;

a seat;

a light bulb socket holder;

wherein the seat is fixed to the reflection cover substantially near the top of the reflection cover;

wherein the base is fixed to the reflection cover substantially near the bottom of the reflection cover;

wherein the lampshade is fixed to the seat substantially near the top of the reflection cover; and wherein the light bulb socket holder is fixed to the reflection cover substantially near the top of the reflection cover.

* * * * *